US006119658A

United States Patent [19]

Jehle et al.

[11] Patent Number: 6,119,658

[45] Date of Patent: Sep. 19, 2000

[54] FUEL NOZZLE INJECTING ONTO THE COMBUSTION SPACE OF AN INTERNAL COMBUST

[75] Inventors: Erich Jehle, Stuttgart; Rolf Kusterer, Fellbach; Bernhard Schwarzkopf, Waldstetten, all of Germany

[73] Assignee: DaimlerChrysler AG, Stuttgart, Germany

[21] Appl. No.: 09/384,027

[22] Filed: Aug. 26, 1999

[30] Foreign Application Priority Data

Aug. 26, 1998 [DE] Germany ..... 198 38 755

[51] Int. Cl.[7] ..... F02M 37/04

[52] U.S. Cl. ..... 123/470; 123/41.31

[58] Field of Search ..... 123/470, 469, 123/472, 41.31, 541

[56] References Cited

U.S. PATENT DOCUMENTS

| | | | |
|---|---|---|---|
| 2,264,914 | 12/1941 | L'Orange | 123/41.31 |
| 3,334,617 | 8/1967 | Palkowsky | 123/41.31 |
| 3,945,353 | 3/1976 | Deisen | 123/41.31 |
| 3,993,030 | 11/1976 | Jaulmes | 123/41.31 |
| 4,296,887 | 10/1981 | Hofman | 239/397.5 |
| 4,487,178 | 12/1984 | Neite et al. | 123/276 |
| 5,794,595 | 8/1998 | Berger | 123/470 |
| 5,878,719 | 3/1999 | Nakagomi | 123/470 |
| 5,960,774 | 10/1999 | Norgauer | 123/470 |

FOREIGN PATENT DOCUMENTS 873011 4/1953 Germany .

OTHER PUBLICATIONS

M–1279 Jul. 14, 1992, vol. 16/No. 321 (Patent Abstracts of Japan), Kubota Corp.

*Primary Examiner*—Carl S. Miller

*Attorney, Agent, or Firm*—Evenson McKeown Edwards & Lenahan P.L.L.C.

[57] ABSTRACT

A fuel injection nozzle injecting onto the combustion space of an internal combustion engine. A shielding of the nozzle holder is provided via a shielding sleeve capable of being pushed axially onto the nozzle neck.

15 Claims, 1 Drawing Sheet

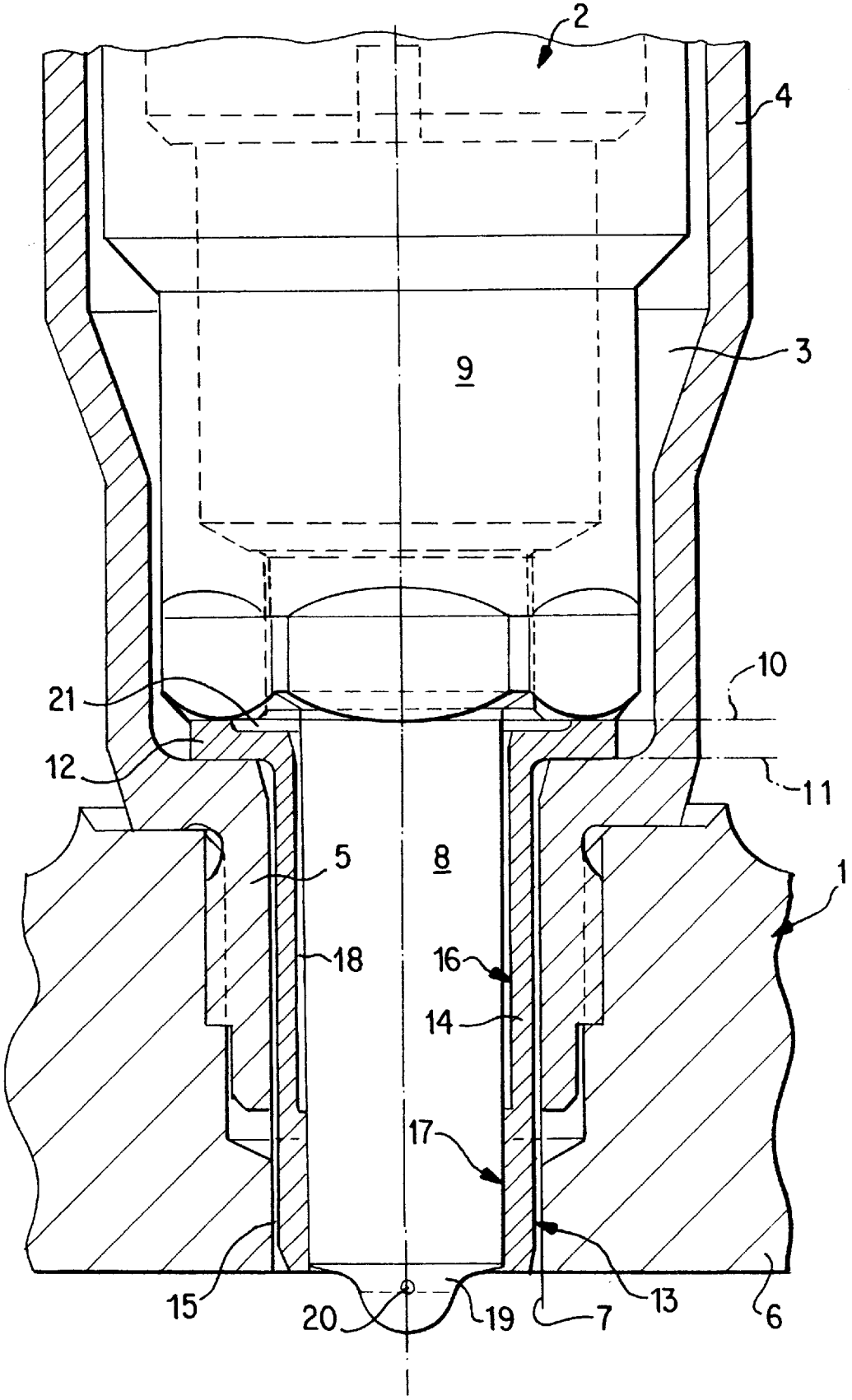
2
4
3
9
10
21
12
11
5
8
1
18
16
14
17
15
20
19
7
13
6

FUEL NOZZLE INJECTING ONTO THE COMBUSTION SPACE OF AN INTERNAL COMBUST

CROSS REFERENCE TO RELATED APPLICATION

This application is related to application Ser. No. 09/384,026, filed on Aug. 26, 1999 in the name of Erich JEHLE et al. for FUEL INJECTION NOZZLE INJECTING INTO THE COMBUSTION SPACE OF AN INTERNAL COMBUSTION ENGINE.

BACKGROUND OF THE INVENTION

This application claims the priority of 198 38 755.5-13, filed Aug. 26, 1998, the disclosure of which is expressly incorporated by reference herein.

The present invention relates to a fuel injection nozzle injecting onto the combustion space of an internal combustion engine. More particularly, it relates to a nozzle which is to is be arranged in a nozzle receptacle located on the same side as the internal combustion engine and open towards the combustion space and has a nozzle body and a nozzle neck stepped relative to the nozzle body. An injection orifice is arranged at the neck end located on the combustion-space side and which is assigned, in the neck region, a shielding sleeve which is located radially on the outside with a clearance relative to the surrounding nozzle receptacle and, starting from one of its ends, bears radially on the inside on the neck without any play via one axial part region and, via another part region, delimits relative to the neck an annular gap and which is provided, at its end facing the nozzle body, with an annular collar which is capable of being clamped in the region of the neck start between the nozzle body and nozzle receptacle.

Fuel injection nozzles are known as seen in German Patent Specification 873,011, particularly FIGS. 2 and 3. If they have a conventional design and conventional functioning, they consist of a nozzle body and a nozzle neck which is stepped in diameter relative to the nozzle body and which has, at the end located on the combustion-space side, at least one injection orifice which is controlled via the nozzle needle and is assigned a shielding sleeve. The shielding sleeve is arranged radially on the outside, with a clearance relative to the surrounding nozzle receptacle, and the corresponding annular gap, starting from the combustion space, extends as far as an annular collar which is assigned to the neck starting region and which is capable of being clamped between bearing surfaces of the nozzle body and of the nozzle receptacle. Starting from the combustion space, an annular gap is provided between the nozzle neck and shielding sleeve. The annular gap does not, however, extend into the upper end region of the nozzle neck, because in this region the shielding sleeve bears with a press fit on the neck and is connected positively to the nozzle neck by, for example, being rolled on.

The result of this design and mounting of the shielding sleeve is that the latter overlaps the nozzle neck virtually completely and, because of the annular gap on the combustion-space side between the shielding sleeve and nozzle neck, is capable of reducing the incidence of heat on the nozzle neck. Also, because of the press-fit connection made in the neck starting region between the nozzle neck and shielding sleeve, this design ensures relatively good heat transmission between the nozzle neck and shielding sleeve, thus resulting in a good transport of heat to the nozzle receptacle.

At the same time, however, by virtue of the above known design the nozzle is loaded and, if appropriate, braced, during production, in the area of the critical region of transition of the nozzle body to the nozzle neck. This is critical on account of the extremely narrow fitting conditions for the nozzle needle and the sliding guidance of the latter which should be as free of play as possible. Furthermore, a design of this kind means that production is relatively complicated and that there are difficulties with regard to the exchangeability of the shielding sleeve in the event of a repair.

SUMMARY OF THE INVENTION

An object of the present invention is to provide a fuel injection nozzle for injecting onto a combustion space of an internal combustion engine, so that, along with a highly protective effect for the shielding sleeve, the connection between the latter and the nozzle can be made simply, not only during initial assembly, but also in the event of a repair, and which, in particular, also makes exchangeability in the garage possible.

This object has been achieved by providing that the shielding sleeve has radially play-free bearing contact on the end region of the nozzle neck which is located on the combustion-space side, and the annular gap between the shielding sleeve and the nozzle neck is closed off as a result of the bearing contact between the nozzle neck and the shielding sleeve, and the bearing contact of the annular collar, located axially at a transition of the nozzle neck and the nozzle body, on the nozzle body.

In the solution according to the invention, the shielding sleeve is brought into bearing contact with the nozzle neck, so as to ensure play-free sealing, in the end region located on the combustion-space side. Thus, this connection can be made, in particular, as a press fit by pushing on the shielding sleeve, if a material which is not too hard is used for the latter.

Thereby, the shielding sleeve can be made thin-walled in its region adjoining this press-fit region, because there are no loads on this region when the shielding sleeve is connected to the nozzle neck.

Furthermore, such a thin-walled approach is a good precondition for ensuring that forces which may possibly act on the annular collar belonging to the shielding sleeve when the latter is braced do not lead to loads on the nozzle neck. This is especially important as there is an annular gap between the nozzle neck and the shield sleeve in the region of transition to that end of the nozzle neck which is located on the combustion-space side and which is connected non-positively to the nozzle neck.

Moreover, because of the sealing bearing contact of the shielding sleeve on the nozzle neck on both sides of the annular gap, the annular gap is a virtually closed insulating space, on which the hot combustion gases do not act directly. The non-positive connection of the shielding sleeve to the nozzle neck gives rise, in the end region of the latter located on the combustion-space side, to substantial protection against the radial irradiation of heat. This is achieved in conjunction with good preconditions for dissipating the heat out of the nozzle neck which penetrates into the latter on its end face.

The solution according to the present invention thus, on one hand, affords the best possible preconditions for achieving good thermal protection for the nozzle neck and combines these advantages with a solution which can easily be mastered in production terms and also in the event of a repair.

Within the scope of the invention, the annular gap closed off sealingly, preferably in a gas-tight manner, between the nozzle neck and shielding sleeve also allows, if appropriate, filling the volume of the annular gap with a suitable insulating material.

When a softer, highly heat-conductive material such as, e.g. copper or copper alloys, is used for the shielding sleeve and the annular collar is braced axially, the possibility of the annular gap being compressed in the collar region and direct support against the nozzle neck thereby occurring is ruled out according to the present invention, by setting back the sealing surface of the annular collar, the sealing surface facing the nozzle body, radially inwards axially. This produces an annular space which takes the form of a radial widening of the annular gap. With regard to the width of the annular collar, it proves expedient to co-ordinate this width with the axial prestress, so as to achieve surface pressure values appropriate to the material used and to the requirements. The result is that, according to the invention, this radial annular space assumes about half the width of the annular collar.

In an embodiment according to the invention, it is advantageous if the axial length of bearing contact between the shielding sleeve and sealing neck is relatively small and corresponds approximately in magnitude, with respect to the diameter of the sealing neck, to half to approximately the entire diameter of the sealing neck. With a view to the desired press fit between the sealing neck and shielding sleeve, it is expedient for the shielding sleeve to be configured with increased wall thickness in the region of the press fit to be achieved. Within the scope of the invention, the relevant thickening is provided preferably radially on the inside and is configured as an annular collar projecting radially inwards in a step-like manner. The radial width of the step-like projection is preferably greater than the annular gap, so that the annular gap can be brought about if the contour of the shielding sleeve is cylindrical radially on the outside.

With regard to the diameter of the nozzle neck, it proves expedient if the wall thickness of the shielding sleeve corresponds, in the region of the annular gap, to about 1/7 to 1/12, preferably 1/10 of the outside diameter of the nozzle neck.

BRIEF DESCRIPTION OF THE DRAWINGS

Other objects, advantages and novel features of the present invention will become apparent from the following detailed description of the invention when considered in conjunction with the accompanying drawings.

The sole FIGURE is a cross-sectional elevational view of a portion of a fuel injection nozzle arranged in a cylinder head of an internal combustion engine.

DETAILED DESCRIPTION OF THE DRAWINGS

The detail shown in the sole FIGURE illustrates a region of the cylinder head 1 which is assigned to the combustion space of the internal combustion engine in which is arranged, opening out onto the combustion space, a partially illustrated fuel injection nozzle 2. An essentially known configuration is assumed for this injection nozzle 2 and the cylinder head 1.

The cylinder head 1 comprises a nozzle receptacle 3 which is accessible from the cylinder head side facing away from the combustion space and which is delimited relative to the water space of the cylinder head by an insert sleeve 4 which is screwed via a neck-like extension 5 into the cylinder head wall located on the combustion-space side, such that, in the prolongation of this neck-like extension 5, that region of the cylinder head wall 6 which faces the combustion space forms part of the nozzle receptacle 3.

The cylindrical inner contour of the neck-like extension 5 and the cylindrical wall region adjoining the latter, of the nozzle receptacle 3, said wall region being formed by the cylinder head wall, lie on a common cylinder envelope which is designated by reference numeral 7. This cylinder envelope 7 forms the outer boundary for that part of the nozzle receptacle 3 into which the nozzle neck 8 of the fuel injection nozzle 2 projects, the nozzle neck 8 adjoining the nozzle holder of larger diameter, together with the nozzle body received by the latter, designated below generally as the nozzle body 9. The step-like transition between the nozzle body 9 and nozzle neck 8, together with the bearing surface 10 formed by the step, has corresponding thereto a shoulder of the insert sleeve 4 at the transition to the neck-like extension 5 of the latter. This shoulder forms a bearing surface 11 corresponding to the bearing surface 10 of the nozzle body 9.

An annular collar 12 of a shielding sleeve, designated generally by numeral 13 is located between the bearing surfaces 10, 11. The shielding sleeve 13 surrounds the nozzle neck 8 radially, the essentially cylindrical portion, adjoining the annular collar 12, of the shielding sleeve 13 being designated by reference numeral 14. The cylindrical portion 14 has a cylindrical outside diameter in the illustrated embodiment and with its outside diameter delimits relative to the cylinder envelope 7 of the nozzle receptacle 3 an annular gap 15. The inner circumference of the essentially cylindrical portion 14 of the shielding sleeve 13 has two regions 16, 17, of which the region 16 adjoins the annular collar 12, so as to form an annular gap 18, and the region 17 is undersized in relation to the diameter of the nozzle neck 8, in the associated region. Thereby, the shielding sleeve 13 sits with a press fit on the nozzle neck 8 via the region 17. This region 17 is assigned to that end of the nozzle neck 8 which is located on the combustion-space side and which is provided with an extension 19 for the injection orifice 20 which is illustrated merely symbolically here.

The annular gap 18 extends axially into the region of the annular collar 12 and thereby adjoins a radial annular space 21 which is formed by the annular collar 12 being axially set back radially on the inside on its end face facing the bearing surface 10. The width of the annular space 21 corresponds approximately to half the width of the annular collar 12, so that a smaller annular surface is obtained for the annular collar 12 in relation to the bearing surface 10 on the nozzle body 9 than in relation to the bearing surface 11 of the insert sleeve 4. A good dissipation of heat to the insert sleeve 4 results therefrom.

Between the annular collar 12 and that region of the thin-walled shielding sleeve 13 located on the combustion-space side, the wall thickness of the shielding sleeve 13 corresponds, in this region, approximately to one tenth of the diameter of the nozzle neck 8. In respect of an injection nozzle for a diesel internal combustion engine of a commercial vehicle, this is on the order of magnitude of up to about 10 mm.

With the diameter of the nozzle neck of about 7 mm, the wall thickness of the shielding sleeve 13 over the region 16 is approximately 0.7 mm, which means, particularly when materials are used for the shielding sleeve 13 which are distinguished by high thermal conductivity but have comparatively low strength such as, for example, copper, that no appreciable forces induced by the bracing of the shielding sleeve 13 relative to the insert sleeve 4 can be transmitted via the shielding sleeve 13.

The forces transmitted from the shielding sleeve 13 to the nozzle neck 8 as a result of the press fit in the part region 17 are, as such, uncritical, especially since they are applied essentially in the end region of the nozzle neck 8, with the end region being closed off on the end face. Moreover, during operation, these forces are at least partially diminished due to heat-induced expansions, or reduced to such an extent that the relevant loads on the nozzle neck 8 may be ignored.

The length of the region 17 is only a fraction of the length of the nozzle neck 8 and is approximately ⅕ to ⅖ of the length of the latter.

The result of the configuration according to the invention is that, in order to connect the fuel injection nozzle 2, the shielding sleeve 13 merely has to be pushed axially onto the nozzle neck 8. The associated purely axial loads on the nozzle neck remain below critical limits and, where appropriate, also are capable of being reduced in that the shielding sleeve 13 can be widened by heating in order to push it onto the nozzle neck 8. That is, the necessary press fit can be achieved at least partially by shrink fitting. A corresponding procedure is also possible in garages, so that the solution according to the invention is also highly advantageous in repair terms.

Within the scope of the invention, there is a further possibility for making a connection between the shielding sleeve 13 and that end region of the nozzle neck 8 which is located on the combustion-space side by a threaded connection, in particular in the form of a fine-pitch thread.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fuel injection nozzle which injects into a combustion space of an internal combustion engine and which is arranged in a nozzle receptacle located on the same side as the internal combustion engine and opens towards the combustion space, comprising a nozzle body, and a nozzle neck stepped relative to the nozzle body, an injection orifice arranged at an end of the neck located on the combustion-space side so as to be associated, in a neck region, with a shielding sleeve located radially on an outside with a clearance relative to the surrounding nozzle receptacle and, starting from one end thereof, to bear radially on an inside of the neck without any play via one axial region and, via another region, to delimit relative to the neck an annular gap and provided, at an end thereof facing the nozzle body, with an annular collar being clampable in a region of the neck starting between the nozzle body and the nozzle receptacle, wherein the shielding sleeve has radially play-free bearing contact on the end region of the nozzle neck which is located on the combustion-space side, and the annular gap between the shielding sleeve and the nozzle neck is closed off as a result of the bearing contact between the nozzle neck and the shielding sleeve, and the bearing contact of the annular collar, located axially at a transition of the nozzle neck and the nozzle body, on the nozzle body.

2. The fuel injection nozzle according to claim 1, wherein the annular gap is closed off as an insulation volume in a gas-tight manner.

3. The fuel injection nozzle according to claim 2, wherein the insulation volume is formed by an air volume.

4. The fuel injection nozzle according to claim 3, wherein the insulation volume receives an insulating material.

5. The fuel injection nozzle according to claim 1, wherein a sealing surface of the annular collar which faces the nozzle body is stepped axially radially on the inside to define an annular space forming a radial widening of the annular gap between the nozzle neck and shielding sleeve.

6. The fuel injection nozzle according to claim 5, wherein the annular space extends approximately over half the width of the annular collar.

7. The fuel injection nozzle according to claim 1, wherein the play-free bearing contact of the shielding sleeve on the end region of the nozzle neck located on the combustion-space side is formed by a press fit.

8. The fuel injection nozzle according to claim 1, wherein the play-free bearing contact of the shielding sleeve on that end region of the nozzle neck located on the combustion-space side is a threaded connection.

9. The fuel injection nozzle according to claim 1, wherein an axial length of the region with play-free bearing contact of the shielding sleeve on the nozzle neck corresponds approximately to the diameter of the nozzle neck.

10. The fuel injection nozzle according to claim 1, wherein the shielding sleeve is a high thermal conductivity material.

11. The fuel injection nozzle according to claim 10, wherein the shielding sleeve is copper or copper-containing material.

12. The fuel injection nozzle according to claim 1, wherein a wall thickness of the shielding sleeve in the region having the annular gap corresponds approximately to the tenth part of its inside diameter.

13. The fuel injection nozzle according to claim 9, wherein the shielding sleeve is configured to be pushed axially onto the nozzle neck.

14. The fuel injection nozzle according to claim 1, wherein diesel oil is provided as fuel to be injected.

15. The fuel injection nozzle according to claim 1, wherein petrol is the fuel to be injected.

* * * * *